United States Patent [19]

Harcüba

[11] 4,002,030

[45] Jan. 11, 1977

[54] PRESSURE FORCE GENERATOR FOR MACHINE TOOLS

[76] Inventor: Siegfried Harcüba, Petersbergstrasse 51, 6600 Saarbrucken, Germany

[22] Filed: Aug. 20, 1975

[21] Appl. No.: 606,098

[30] Foreign Application Priority Data

Aug. 21, 1974 Germany ..... 2440163

[52] U.S. Cl. ..... 60/581

[51] Int. Cl.[2] ..... F15B 7/00

[58] Field of Search ..... 60/325, 533, 539, 549, 60/574, 576, 581

[56] References Cited

UNITED STATES PATENTS

| | | | |
|---|---|---|---|
| 3,021,678 | 2/1962 | Pagley | 60/581 |
| 3,214,914 | 11/1965 | Kling | 60/581 |
| 3,423,938 | 1/1969 | Cavalieri | 60/549 X |
| 3,645,126 | 2/1972 | Kralowetz et al. | 60/581 X |

*Primary Examiner*—Edgar W. Geoghegan
*Attorney, Agent, or Firm*—Oblon, Fisher, Spivak, McClelland & Maier

[57] ABSTRACT

A pressure force generator for machine tools is disclosed as having at least two pneumatically-hydraulically operated pressure multipliers in which the multipliers and their plungers are connected to a single high-pressure container containing a liquid.

5 Claims, 7 Drawing Figures

PRESSURE FORCE GENERATOR FOR MACHINE TOOLS

Figure 1:
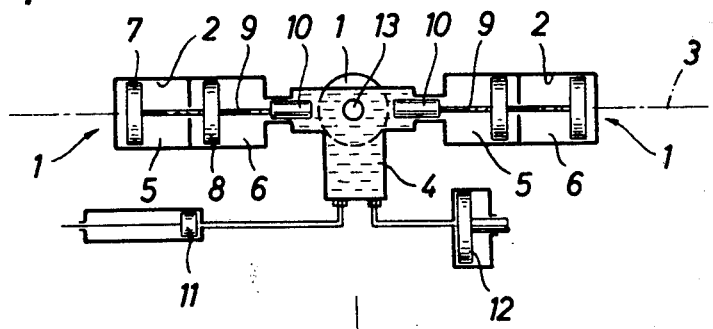

The invention relates to a pressure force generator for machine tools having at least two pneumatically-hydraulically operated pressure multipliers, each of which comprises at least two pressure air pistons the piston rods of which have plungers at their ends.

There are known different methods of converting energy in the form of pressurized air into mechanical energy. One of these methods includes pressurized air acting on one or more pressurized air pistons which are attached to a common piston rod for delivering a mechanical force along a predetermined path.

It is further known to multiply such a mechanical force by means of a hydraulic pressure converter in order to achieve the required pressure force, for example, in machine tools, such as, presses.

The cylinder diameter and the cylinder stroke of a pneumatic pressure multiplier are dependent on the press work to be done, as may be seen by the formula $A = Ps$ (where P is the pressure force and s is the working path). Such a relationship shows that from a pressure force of approximately 60 Mp upwards, and a stroke of approximately 3 cm as well, the diameter, as well as the construction height of the air cylinders arranged with respect to one another in a line, becomes improportionately large and when the capacities are to be increased, the mentioned construction is no longer practical. Accordingly, an impractical building of large volume, and with regard to its stability, an adequately strong and heavy frame construction would be required. Another construction disadvantage emerges in view of the construction of guide means for pneumatic pistons having a large diameter or to compensate for the buckling stresses of the piston rod. Finally, such a construction is also comparatively expensive, not to mention its technical disadvantages.

It is an object of the invention to overcome these shortcomings and to provide a pressure force generator for machine tools which uses pressurized air which can produce pressure forces of up to 100 Mp, and a multiple thereof, and which is built on a comparatively small scale and with a comparatively small construction height, and with which, the working path, as well as the working velocity, can be controlled in steps whereby the pressure force remains constant.

The object of invention will be achieved in such a way that all multipliers and their plungers are connected to a single high-pressure container containing a liquid.

The volume of the high-pressure container for the liquid is determined by the predetermined path of the generated forces and remains equally large in each working position of the plungers or the tools whereby the working path of the tools and the working paths of the plungers are given by the predetermined ratio of the hydraulic transfer. It would be possible to overcome the large working paths of the hydraulic work piston (with the attached tool) with relatively small plunger strokes when the plunger cylinders are built as pump cylinders in the known way and the required quantity of liquid is sucked in from a liquid container and delivered under pressure into the high-pressure container containing a liquid.

Another advantage arises from the arrangement of two or more pneumatic-hydraulic pressure force generators which will be subsequently explained:

1. INFLUENCING OF THE WORKING VELOCITY (C CM/SEC)

The pneumatic control should be arranged in such a way that the pneumatic cylinders could be made effective simultaneously as well as in sequence one after another. With two cylinders there will be achieved in the first case as against the second case a double velocity of the tool, with n-cylinders an n-multiple of velocity. Accordingly, with a predetermined maximum working velocity this maximum velocity, can be halved or it can be reduced to an n-part of the same — only in an inverse sense - . The more pressure multipliers that are used, the more finely is graduated the control of the working velocity. When machining different materials the tool velocity plays a considerable role as far as the quality of the machining is concerned. Tests have shown that four to six steps or pump cylinders are sufficient to meet practically all requirements.

2. INFLUENCING OF THE WORKING PATH (S CM)

When constructing a cutting or a shaping press the maximum working path of the tool is determined, for example, by the largest expected height or thickness of the workpiece to be machined. When, however, thinner metal sheets or flat materials are to be machined — which is usually the case — the tool still has to traverse the entire stroke which results in a considerable loss of time especially with a high number of strokes and an unnecessary wear of the piston linings.

Because of the arrangement of two or more pressure multipliers which are connected with a single, common, high-pressure container containing the liquid, the tool can be brought into the proximity of the workpiece by the movement of one or more of the pressure multipliers into their lower dead positions where they are held and from where the working path then begins, the working path therefore being carried out by the remaining pressure multipliers.

The pressure force remains constant when influencing the working velocity as well as the working path when there exists a constant pneumatic inlet pressure so that even the ratio of the hydraulic transfer remains the same.

Figure 2:
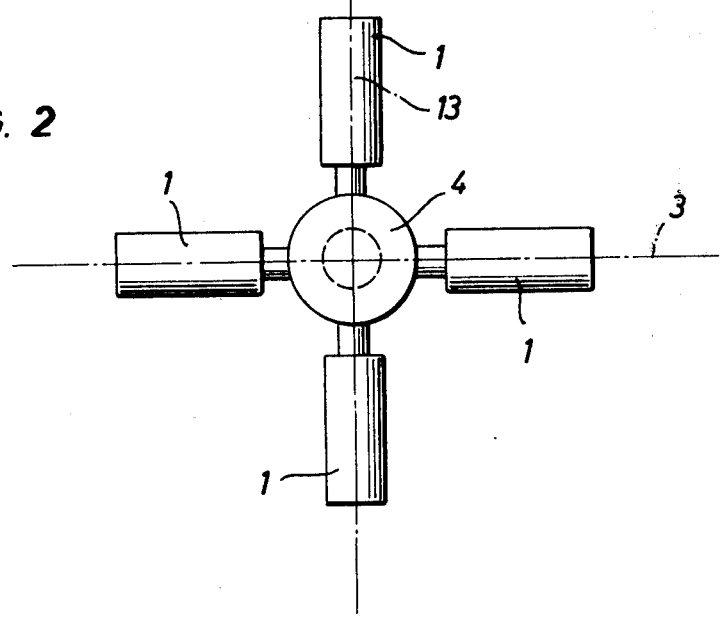
Figure 3:
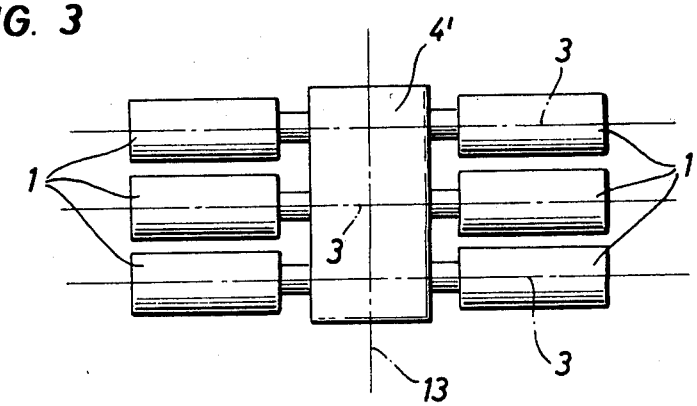
Figure 4:
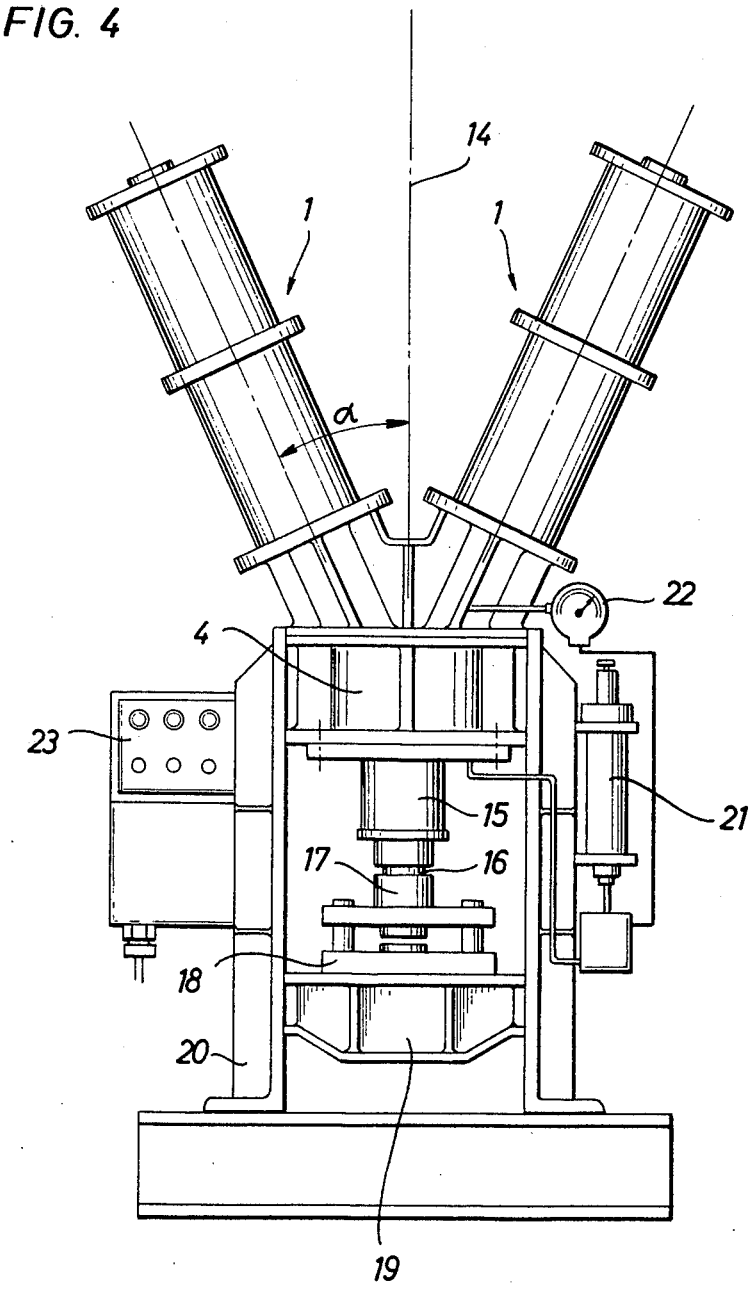
Figure 5:
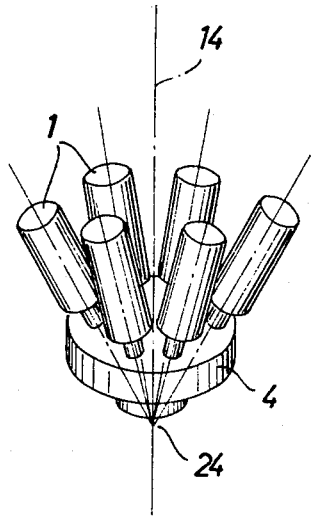
Figure 6:
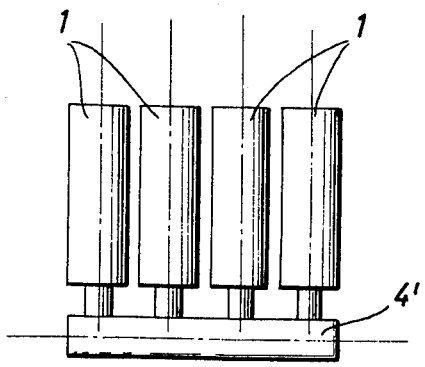
Figure 7:
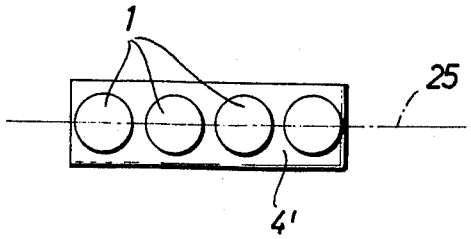

How the pressure multipliers can be utilized in conjunction with a high-pressure container containing the liquid will now be described in connection with the accompanying drawings in which FIG. 1 is a vertical section of a high-pressure container containing a liquid with two pneumatic-hydraulic pressure multipliers arranged in a line, FIG. 2 shows a plan view of a high-pressure container containing a liquid having four pressure multipliers which are arranged in one horizontal plane, FIG. 3 shows a plan view of a high-pressure container containing a liquid having six pressure multipliers which are arranged in a horizontal plane in such a way that three pressure multipliers lie on each side of the high-pressure container, FIG. 4 shows a front view of a pressure force generator the pressure multipliers of which are arranged at an angle to the vertical plane of the generator, FIG. 5 shows a pressure force generator having six pressure multipliers which are connected with a single high-pressure container containing a liquid the longitudinal axes of which intersect at one point, and FIGS. 6 and 7 show a side view and a plan view respectively of a pressure force generator having four pressure multipliers the longitudinal axes of which are parallel. As can be seen from FIG. 1, two pressure multipliers 1 are arranged in such a way that their longitudinal axes lie on a straight line 3, which line intersects a high-pressure container 4 for liquid. In each of the partial chambers 5 and 6 of the multiplier there is accommodated one piston 7 or 8, which pistons are attached to a common piston rod 9 having plungers 10 on their free ends. By moving the plungers 10 towards each other a pressure is produced in the high-pressure container 4 which pressure serves for moving two working pistons 11 and 12 of different diameters. It is comprehensible that control means can be provided by means of which the pressure in the high-pressure container 4 is controlled to act on only one of the pistons. If there are provided three pressure multipliers 1 connected with a single high-pressure container 4 and having their longitudinal axes in a horizontal plane, the longitudinal axis 13 of at least one multiplier 1 traverses the straight line 3. As can be seen from FIG. 2 there can be provided four pressure multipliers 1 connected to a single high-pressure container 4. In case more than four pressure multipliers 1 are required, it is recommended — as far as the embodiments according to FIGS. 1 and 2 are concerned — to arrange the same in a star-type configuration in one plane, whereby the angles between the neighboring longitudinal axes should be the same.

FIG. 3 shows another embodiment. On each side of a high-pressure container 4′ there is arranged three pressure multipliers 1, the longitudinal axes of which lie in a horizontal plane, whereby the longitudinal axes of two opposite pressure multipliers lie on one straight line 3 so that three straight lines 3 are disposed parallel to one another in this case. It is comprehensible that one or two additional pressure multipliers 1 could be connected with the high-pressure container 4′ in such a way that, for example, their longitudinal axes would lie on the straight line 13.

In an embodiment according to FIG. 4 there are arranged the pressure multipliers 1 at an angle to the vertical line 14. This embodiment comprises only two pressure multipliers 1, however, there can be provided more than two pressure multipliers to be connected with a single high-pressure container 4 as can be seen from FIG. 5. A piston positioned in a working cylinder 15 and impacted by the pressure from the high-pressure container 4 is connected with a piston rod 16 which rod carries a tool, in this case a precision cut punch 17, under which a matrice 18 is disposed supported by a girder 19. A frame 20 absorbing the pulling forces connects the high-pressure container 4 with the girder 19. A control device is disclosed at 21, a pressure sensing means at 22 a control panel at 23.

It is evident from FIG. 5 that the longitudinal axes of all multipliers 1 of this embodiment intersect at one point 24 which is disposed on the vertical line 14.

The embodiments according to FIG. 6 and 7 show that the pressure multipliers 1 can also be arranged in such a way that their longitudinal axes run parallel to one another and intersect a horizontal straight line 25.

The features of one embodiment can be combined with those of another embodiment. It is to be mentioned that the high-pressure container containing the liquid can be connected with a working cylinder for a large force and a short working path and/or with a working cylinder for a large working path and a small force as it can be seen from FIG. 1.

What is claimed is:

1. A pressure force generator for machine tools comprising:

at least two, separate and independent, pneumatic-hydraulic pressure multipliers;

a single, high-pressure container directly connected to each of said multipliers and containing hydraulic fluid to be pressurized by said multipliers in order to actuate at least one of said machine tools;

each of said multipliers including two pneumatically-operated pistons mounted upon a single piston rod at one end thereof, and a plunger mounted upon said piston rod at the other end thereof and disposed within said hydraulic container for pressurizing said hydraulic fluid within said container; and control means for selectively actuating said multipliers, either simultaneously, sequentially, or singly, whereby the pressurization of said hydraulic fluid may be selectively controlled as desired or required so as to in turn selectively control the operation of said at least one of said machine tools.

2. Generator according to claim 1, characterized in that the multipliers are arranged in a horizontal plane.

3. Generator according to claim 1, characterized in that the multipliers are positioned at an angle to the vertical.

4. Generator according to claim 1, characterized in that the longitudinal axes of the multipliers intersect one axis.

5. Generator according to claim 1, characterized in that the longitudinal axes of the multipliers intersect in one point.

* * * * *